US005737865A

United States Patent [19]

Brandl et al.

[11] Patent Number: 5,737,865

[45] Date of Patent: Apr. 14, 1998

[54] REPEATER SHOT GUN

[75] Inventors: Rudolf Brandl, Dornhan-Weiden; Heinz Matt, Oberndorf, both of Germany

[73] Assignee: Heckler & Koch GmbH, Oberndorf am Neckar, Germany

[21] Appl. No.: 624,979

[22] Filed: Mar. 28, 1996

[30] Foreign Application Priority Data

Mar. 31, 1995 [DE] Germany ..... 195 12 178.3

[51] Int. Cl.[6] ..... F41A 21/00

[52] U.S. Cl. ..... 42/75.02; 42/75.03; 42/17

[58] Field of Search ..... 42/75.02, 75.03, 42/70.01, 17; 224/149, 103, 913

[56] References Cited

U.S. PATENT DOCUMENTS

| | | | |
|---|---|---|---|
| 1,110,702 | 9/1914 | McClure | 42/75.02 |
| 2,893,153 | 7/1959 | Hailston et al. | 42/75.02 |
| 3,721,031 | 3/1973 | Falterman et al. | 42/1 L |
| 3,849,925 | 11/1974 | Mayer | 42/75 R |
| 4,087,930 | 5/1978 | Grehl | 42/75 B |
| 4,531,322 | 7/1985 | Termet | 42/1 M |
| 4,856,217 | 8/1989 | Benelli | 42/17 |
| 5,247,758 | 9/1993 | Mason | 42/75.02 |
| 5,513,461 | 5/1996 | Weldle | 42/71.01 |
| 5,540,008 | 7/1996 | Kirnstatter | 42/75.02 |

*Primary Examiner*—Charles T. Jordan
*Assistant Examiner*—Meena Chelliah
*Attorney, Agent, or Firm*—Darby & Darby

[57] ABSTRACT

A repeating shot gun, in particular a automatic shot gun, is provided with at least one barrel (29) which is rigidly attached to a plastic housing (1) when the gun is assembled, the shot gun having a coupling (3) formed either from a metal or from a material having properties similar to those of metals with respect to deformation and strength and having a barrel receiver (5) which is rigidly positioned in the housing (1), such that the barrel receiver (5) substantially coaxially surrounds the rear portion of the barrel (29) and the barrel (29) is in close-fitting engagement with the barrel receiver (5).

18 Claims, 2 Drawing Sheets

REPEATER SHOT GUN

BACKGROUND OF THE INVENTION

1. Field of the Invention

The invention relates to a repeater shot gun, in particular to a automatic shot gun, having at least one barrel rigidly attached to a housing when the gun is assembled.

In the following, statements referring to a location, like "above, "below", "front", or "rear" always refer to the normal orientation of use of a repeater shot gun, where the axis of the bore is oriented horizontally. Here, "forward" has the same meaning as "direction of firing".

2. Description of the Related Art

In many known automatic shot guns (e.g. system Browning), the barrel is movably attached to a housing. After a shot has been fired, the barrel and the breech are at first locked in relation to each other. During the reloading process, they travel rearward together over the entire distance. Subsequently, the barrel moves forward by itself. Only after the barrel has reached its forward end position does the breech follow.

The mass which moves rearward after a shot has been fired, is relatively large in such system and it therefore has a relatively small velocity. The major portion of the recoil is not transmitted directly to the housing, but indirectly via a counter-recoil spring. Thus, the recoil action is not transmitted to the housing suddenly and in full force, but over a certain period of time with a correspondingly lesser force. The load on the housing is therefore relatively small. On the other hand, such system requires a relatively complicated and therefore expensive design.

U.S. Pat. No. 3,512,290 (VIOLETTE) teaches a repeater shot gun wherein the barrel is rigidly attached to a housing. It is suggested in this reference to arrange a automatic shot gun system which is known in the art and which includes a barrel, metal housing, breech and reloading mechanism with tubular magazine, within a light and robust plastic exterior housing. Herein, the plastic exterior housing, which has the advantage of lower cost, replaces the wooden gun-stock which until then was usually used for automatic shot guns. The internal metal housing provides the stability for this design. This design has the advantage of comparatively greater simplicity and therefore is more economical.

Furthermore, use of plastic material for the construction of butts and gun-stocks for fire arms is known from EP 0 108 031 B1 (PACHMAYR), DE 36 40 528 A1 (STURM I), and DE 39 29 378 A1 (STURM II).

SUMMARY OF THE INVENTION

The object of the present invention is to further simplify the design of a repeater shot gun, in particular a automatic shot gun, and to reduce the weight of such weapon. This objective is attained by providing a repeater shot gun, in particular a automatic shot gun, with at least one barrel rigidly attached to a housing when the gun is assembled, wherein the housing is manufactured from plastic, and a coupling which has a barrel receiver is rigidly positioned in the housing, such that the barrel receiver substantially and coaxially surrounds the rear portion of the barrel and is in close-fitting engagement with the barrel, the coupling being formed either from a metal or from a material having properties similar to those of metals with respect to deformation and strength.

Herein and hereafter, the designation "plastic" is meant to comprise reinforced as well as not reinforced plastic material. This material can have thermoplastic or duroplastic properties. Reinforcement can comprise glass fibers or strands made out of glass fibers. The fiber could, for instance, be wound in a particular pattern or have the consistency of quite long staple fibers. One could also add randomly oriented short fibers sections or fibers sections with at least one preferred fiber orientation to the plastic material.

An obvious simplification of the aforementioned repeater shot gun (U.S. Pat. No. 3,512,290) with a rigidly attached barrel would be to omit the plastic exterior housing and to design the actual metal housing in such a manner that it assumes all the functions of the exterior housing. The present invention, however, proceeds in just the opposite manner. Herein, the metal housing is eliminated and the plastic exterior housing is improved so that it can assume the functionality of the metal housing. The metal or metal-like coupling now supports the barrel and is itself rigidly connected to the plastic housing. As a consequence, when a shot is fired, the recoil is transmitted directly via the coupling to the plastic housing. In addition, contributions from forces which occur symmetrically around the axis of the bore, can be compensated almost completely in the comparatively hard metal. The load on the plastic housing is then correspondingly smaller. When the barrel is mounted removably, the material selected for the coupling furthermore prevents excessive wear.

The limited strength of plastic materials on one hand, and the rather strong recoil, particularly with shot guns, on the other hand, taught those artisans away from ideas on which the present invention is based. It did not seem possible to utilize a larger quantity of plastic material. Contrary to all expectations, however, the inventive embodiments have proven to be rather sturdy and enduring.

It is known in the art, G 93 04 489.5 (HECKLER & KOCH), to provide a rapid firing rifle with a plastic housing; and although the recoil encountered here is much weaker than the recoil expected for a shot gun, there were indications that the breaking point was almost reached.

The reason for the unexpected durability of the plastic housing may possibly have been the selection of a plastic material, e.g. polyamide 12, like VESTAMID L-GF, 15/30 from the company Hü AG, Marl, with the following elastico-viscous properties: the material will deform under a rather small permanent load; it will, however, withstand a much higher pulsed load if that load is applied only for a very short time. If this is the case, then the rigid attachment of the barrel to the housing will enhance rather unexpectedly the durability of the plastic housing, instead of adversely affecting it.

In the barrel receiver, there is preferably disposed a reduction sleeve which directly accepts the rear portion of the barrel and which consists of a metal or a material with properties similar to those of metals with respect to deformation and strength. With this arrangement, the coupling and the barrel receiver on one hand and the reduction sleeve on the other hand can advantageously be adapted independently for their intended purpose. The reduction sleeve can also be manufactured from a material which can suitably interact with a movable breech of the repeater shot gun.

Additionally, the barrel and the reduction sleeve and/or the barrel receiver of the coupling are preferably connected via thread means. This enables a particularly simple exchange or removal of the aforementioned parts.

In another preferred embodiment, at least one jut or anchor jut extends at least partially within the plastic material and is formed on the coupling. This design provides a larger engagement area between the barrel, the coupling, and the or each anchor jut on one hand and the plastic material of the housing on the other hand. In this way, the recoil can most reliably be transmitted into the plastic housing via compressive force, tensile force, and/or shear force, without locally reaching or surpassing the housing's breaking point.

Preferably, at least one of the anchor juts extends essentially parallel to the longitudinal direction of the housing. Hereby, the entire housing is reinforced further. In this manner, it becomes less sensitive to blows or shock.

Furthermore, at least one anchor jut is provided with at least one through bore hole. If, for example, an injection molding process is used to house the coupling in the plastic housing, then the plastic material cross-links during the fabrication process. This provides a much better seat for the coupling. The coupling can also be attached removably, e.g. via a screw or a bolt which extend(s) through the bore hole(s). For this purpose, the bore hole can also be threaded. A coupling which is fitted into a steel part in this manner, wear less than a coupling which is molded or glued in the plastic material.

In another preferred embodiment, the coupling is provided with a magazine receiver of a reloading mechanism. This way, the weapon can be manufactured with a much simpler process. The reloading mechanism can be designed quite arbitrarily, for instance in the form of a drum, an ammunition belt, etc. An ammunition belt can be useful for ordinance weapons which are adapted for shotgun pellets or related special cartridges (cartridges for firing steel-cored bullets, gas grenades, flechettes, smoke grenades and flares, etc.). Such reloading mechanisms are attachable or attached to some kind of holder at the housing which provides for the correct relative orientation between the reloading mechanism and the path of the breech. These holders will hereafter be called "magazine receivers", just as the holders for conventional magazines, i.e. bar magazines, drum magazines, or tubular magazines.

It is a further advantage of the above described embodiment that the magazine receiver, in cooperation with or in place of the anchor jut, distributes the recoil over a large area which in turn transmits the recoil to the plastic housing without damaging it. Additionally, the relative position between the magazine receiver and the coupling and therefore between the magazine and barrel or breech is established and will not be adversely affected by a delay in molding process of the plastic housing or by its elastic deformation during the recoil. This permanently guarantees a reliable reloading process.

The barrel receiver and the magazine receiver are preferably formed in the coupling as two tubes which are substantially parallel to each other, with one tube positioned on top of the other. Herein, the magazine receiver is shaped for accepting a tubular magazine. The magazine receiver of the repeater shot gun according to the invention can also be formed as a bore in the housing, in the same manner as for prior art automatic shot guns. The special advantage of the invention, however, is that the magazine receiver is formed on the coupling. The magazine bushing performs at the same time the function of an anchor jut.

Preferably, connecting means are provided for rigidly connecting the magazine and the magazine receiver, as well as attaching means for rigidly attaching the barrel to the magazine. This design eliminates the need for additional attaching means, especially between the rear barrel end and the reduction sleeve or the barrel receiver, as the case may be. Therefore, the barrel can be fixedly positioned in the barrel receiver or in the reduction sleeve, without being rigidly connected to them. This guarantees a particularly lasting attachment which will not be affected by, for instance, the difference in thermal expansion between the barrel end and the barrel receiver. Such difference in thermal expansion occur immediately after firing a shot because at that time the barrel becomes substantially hotter than its surroundings.

In another preferred embodiment, the coupling is inserted into the plastic housing independent from other inserted parts. This allows a particularly simple and cost-effective manufacturing process.

In another preferred embodiment, a guide notch for a breech is provided on the plastic housing. This design eliminates the need for additional parts, like separate guide rails, and the associated assembly steps.

Preferably, at least two opposing notches are formed on the inside wall of the reduction sleeve, and at least two corresponding locking juts are formed on the breech. In principle, it is possible and even customary to form the mating surface(s) with which the locking jut(s) engage(s), directly on the barrel receiver. It became clear, however, that it would be advantageous to form the mating surface(s) in a separate reduction sleeve which, in turn, is positioned inside the coupling. This makes it feasible to utilize a rather convenient fabrication method (e.g. investment casting) for an integrated workpiece comprising a barrel receiver, magazine bushing, and anchor juts; this fabrication method, however, necessitates a substantially uniform wall thickness or a material, like a light alloy, which, due to its strength, would not be suitable for forming the mating surface(s). On the other hand, the part having the mating surface(s) does not work itself loose as a result of vibrations and shock which occur between the barrel and the part having the mating surface(s) when a shot is fired, since this part is not embedded in plastic, but fastened to the receiver, i.e. it is affixed by wedges, pins, screws or other fastening means. It is particularly advantageous when two opposing locking juts are provided. This arrangement prevents any asymmetric load which could lead to a jamming of both the reduction sleeve and the coupling.

In another preferred embodiment, at least one of the notches is beveled on the side facing away from the barrel. A corresponding locking jut is movable in a direction perpendicular to the longitudinal axis of the barrel. Additionally, there is provided a biasing means which acts on the respective locking jut and forces it into the corresponding notch. Furthermore, when a shot is fired, a corresponding locking jut is —as a result of the recoil—pressed against the bevel which functions as a radial cam, and disengages from the respective notch counteracting the biasing means.

As mentioned above, it is the fact that the barrel is firmly mounted in the housing, which quite unexpectedly makes it possible to utilize plastic material for the housing. With this, the shot gun of the invention can be realized as a repeater shot gun, and preferably as a front-loading gun (pump-gun). It is more difficult to build a automatic shot gun. However, a automatic shot gun with a rigid barrel is known in the art (Winchester), wherein a bushing for accepting the cartridge holder is movably inserted in the barrel and lockable with the breech. This design, however, tends to open prematurely when special ammunition is used, such that the breech, at the end of its path, impacts the housing with a high velocity. In the present invention, a new breech design is proposed. The repeater shot gun has a beveled notch on the side facing away from the barrel, a corresponding locking jut movable in a direction perpendicular to the longitudinal axis of the barrel; a biasing means is provided which acts on the respective locking jut and forces it into the corresponding notch; and when a shot is fired, a corresponding locking jut is —as a result of the recoil—pressed against the bevel which functions as radial cam, and disengages from the respective notch counteracting the biasing means. For such a "delayed" breech there is provided a breech block which touches the bottom of a cartridge when the gun is fired and engages with the locking juts into the mating surface(s). The recoil acts upon the closure head and attempts to move it rearward, whereas the locking juts delay this motion by disengaging only slowly from their engagement with the mating surfaces. Preferably, the locking juts are movably positioned in relation to the breech block and are biased by breaking means. Preferably, this breaking means is formed by a locking device which is biased by a closure spring and supported on the locking juts via a gear mechanism; the gear mechanism translates the slow motion of the locking juts upon their disengagement from the mating surfaces into a rapid motion of the breech device in the direction into which it opens, such that —after the actual recoil has subsided—the locking device pulls the breech head back, together with the locking juts and the spent shell casing, and initiates the reloading process.

In still another preferred embodiment, mounting means are embedded in the plastic material for mounting the housing to a gun-stock and/or for mounting ancillary devices on the housing. The mounting means, for instance, could be in the form of threaded inserts. Such threaded insert is, for instance, embedded in an extension of the rear portion of the plastic housing and adapted to accept the system fastening screw which passes through the rear gun-stock of the shot gun. It would also be possible to embed mounting means in the top portion of the plastic housing which could then be used for accepting a mounting screw for mounting an aiming and/or illumination device.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

The invention is described in more detail in the embodiments and in the appended, schematic drawings. In the drawing is shown in.

DETAILED DESCRIPTION OF THE PRESENTLY PREFERRED EMBODIMENTS

Figure 1:
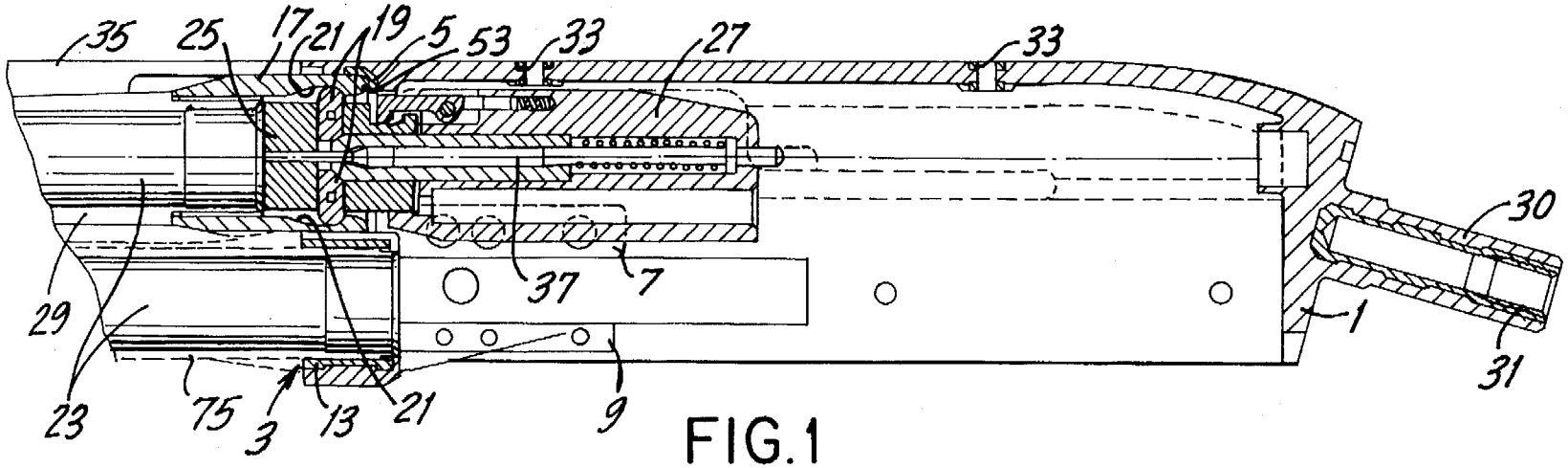
FIG. 1 is a partial longitudinal sectional view of a automatic shot gun according to the invention.

The automatic shot gun of FIG. 1 has a substantially box-shaped plastic housing 1, which is gently rounded downwardly at the top portion of its rearward outer end. In this housing there is embedded a coupling 3 made out of metal which is illustrated more clearly in FIGS. 2 and 3.

Plastic materials to be considered are thermoplastics or duroplastics which preferably have fibers embedded in them as reinforcement, most preferably glass fibers. The housing 1 is manufactured mainly without cutting through the utilization of injection molding, pressing or other forming techniques. However, it can be finished and preferably is finished in certain areas, for instance by drilling cross bore holes.

Figure 2:
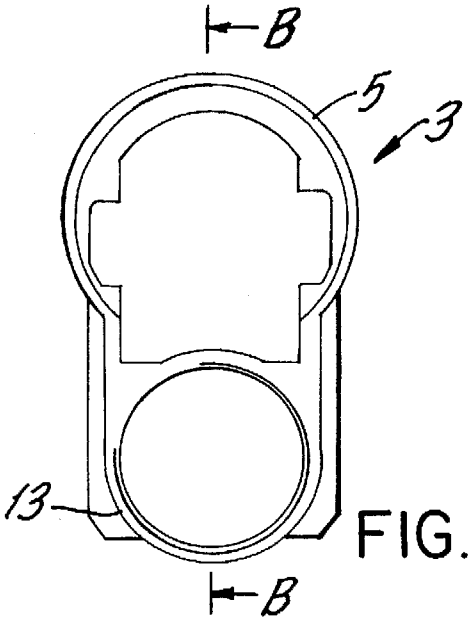
FIG. 2 is a front view of a coupling in an enlarged scale in comparison to FIG. 1.
Figure 3:
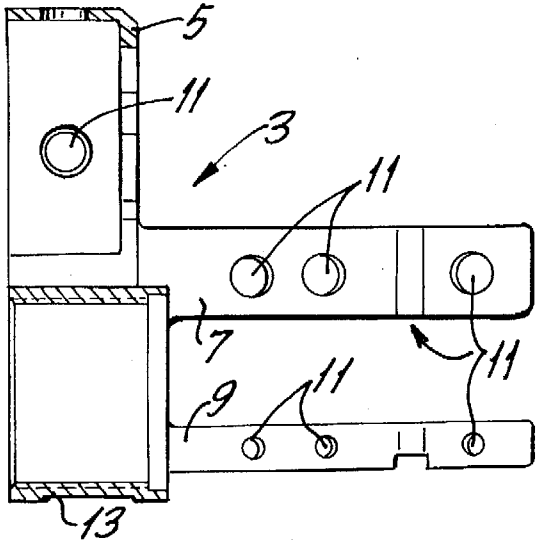
FIG. 3 is a section through the coupling in FIG. 2 taken along the line B—B in FIG. 2.

The coupling 3 comprises a sleeve-type barrel receiver 5 and a likewise sleeve-type magazine receiver 13 which is positioned parallel to and below the barrel receiver 5. In addition, there are provided two middle anchor juts 7 and two lower anchor juts 9. The middle anchor juts 7 are shaped in the form of fins and extend horizontally rearward on both sides of the center plane B—B (FIG. 2), starting at the transition between barrel receiver 5 and magazine receiver 13. The lower anchor juts 9 are likewise shaped in the form of fins and extend horizontally rearward on both sides of the center plane B—B (FIG. 2). These juts, however, start at the lower back side of the magazine receiver 13. The lower anchor juts 9 are narrower than the middle anchor juts 7, when measured parallel to the plane B—B, but extend rearward over the same distance. The front of the coupling 3 is positioned in a vertical plane perpendicular to the plane B—B. All exterior surfaces of the coupling 3, with the exception of the front surface, are wetted by the plastic material of the housing 1 and bonded to it. The barrel receiver 5 and the anchor juts 7 and 9 on the coupling 3 are provided with bore holes 11 which are filled with plastic material unless they are designed to receive a functional element. By this method, joggled joints strengthen the bond between the metal of the coupling 3 and the plastic material of the housing 1 even more. Furthermore, the surfaces of the coupling 3 which are wetted by the plastic material, can—at least partially—either be roughened or provided with a surface coating—for instance a phosphate treatment—for improving the adhesion of the plastic.

The coupling 3 is formed as a single piece, for instance as a piece of forged steel where essentially all sides have been finished, or as a steel investment casting where at least the internal surfaces of barrel receiver 5 and magazine receiver 13 have been finished by machining, or as an aluminum die-casting in which case metal-cutting finish work, aside from deburring, may be unnecessary.

The barrel receiver 5 is somewhat shorter than the magazine receiver 13. It is provided at the rear with an interior flange or supporting surface 53 forming the support for a reduction sleeve 17 made from steel or another hard metal. The reduction sleeve 17 is inserted from the front into the barrel receiver 5 and rests on the aforementioned interior flange 53. The reduction sleeve 17 can be permanently affixed to the barrel receiver 5, for instance via pressing, shrinking, gluing, etc., and is preferably and in addition secured by a pin fastener. A properly dimensioned pin fastener alone may already be sufficient as permanent attachment. The reduction sleeve 17 having an essentially cylindrical, towards the front slightly conical section, protrudes towards the front beyond the barrel receiver 5 and the coupling 3, and can in addition comprise an interior thread. The end of a barrel 29 having a mating external thread may be screwed into the sleeve.

Figure 4:
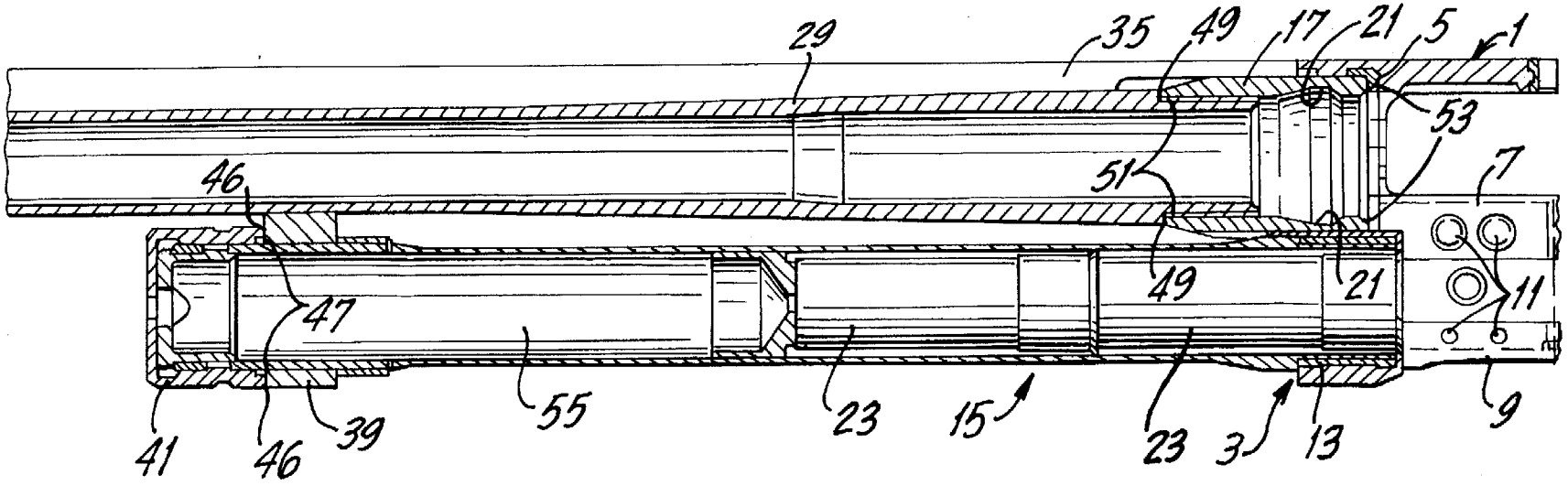
FIG. 4 is another partial longitudinal sectional view of the automatic shot gun of FIG. 1.

In FIG. 4, the reduction sleeve 17, the barrel receiver 5, and the end of the barrel are not screwed together or otherwise rigidly attached to each other —which is different from the preceding discussions. Instead, a tubular magazine 15 is screwed onto the magazine receiver 13, i.e. is rigidly connected with the housing 1. Rigid mounting of the barrel 29 in the barrel receiver 5 either directly above or —as shown in FIG. 4—indirectly above the reduction sleeve 17, is accomplished via this rigidly mounted tubular magazine 15. For this purpose, a flange 39 is rigidly coupled to the barrel 29. The flange 39 is provided with a through bore adapted to accept the tubular magazine 15. The weapon is then further assembled via the following steps: first, the barrel 29 is loosely inserted into the reduction sleeve 17 and both parts are then pushed into the barrel receiver 5, until the front end of the tubular magazine 15 passes through the circular flange 39. Then a union nut 41 is screwed onto the front end of the tubular magazine 15. Hereby, the rear edge 46 of the union nut 41 engages the front edge of the flange 39, such that the barrel 29 is moved further to the rear (towards the housing 1). The rearward motion of the barrel is continued until the rear edge 49 of the barrel 29 pushes against a front edge 51 of the reduction sleeve 17 and the rear end of the reduction sleeve pushes against a support surface 53 of the barrel receiver 5, such that the barrel 29 rests firmly against the barrel receiver 5. It is useful to provide for sufficient play between the union nut 41 and the front portion of the tubular magazine 15 in order to accommodate any deviations in length of the barrel 29. There is an additional feeding mechanism 55 visible in FIG. 4. It comprises spring means (not shown) and transports the cartridges rearwardly upon reloading.

Inside the barrel 29 there is provided at the rear end a cartridge magazine in which a cartridge 23 is shown. The barrel 29 and simultaneously the bottom of the cartridge 23 terminate within the portion of the reduction sleeve 17 which protrudes beyond the coupling 3.

On top of barrel 29 is affixed a running rail 35 which extends rearward beyond the top of the reduction sleeve 17 up to the housing 1 where it terminates flush with the housing 1. The inside bore diameter of the reduction sleeve 17 is smaller than the inside diameter of the inside flange 53 of the barrel receiver 5. Additionally, the rear end of the inside bore of the reduction sleeve 17 is provided with a counter bore. Within the inside bore of the reduction sleeve 17 a recess 21 is formed on both the top and the bottom side, the rearward end of which is beveled and transitions into the surface of the inside bore.

Threaded inserts 33 are inserted into the top wall of the housing 1 whose threaded bore passes through the housing wall and merges with the extension of the running rail on the outer surface of the housing 1. Fastening screws for, e.g., an aiming device and/or an illumination device can be screwed into these threaded bores.

The rear end of the housing is formed by a connection piece 30 extending rearward and downward at an oblique angle, the orientation of which coincides with that of the stock handle when the rear gun-stock is attached. A threaded insert 31 for possible engagement with a fastening screw passing through the rear gun-stock in a fashion which is known in the art, is inserted into this connection piece.

Preferably, the threaded inserts 31 and 33 and the coupling 3 form together with the plastic material an integral housing which can be produced via composite casting by way of coating the parts 3, 31, and 33 with plastic material.

On the other hand, threaded inserts, like the inserts 33, can also be attached to the wall of housing 1 afterwards, e.g. by gluing the inserts 33 into a drilled bore hole. This could be advantageous if a automatic shot gun according to the invention is initially offered without optional aiming or illumination devices, but is upgraded with such options at a later time. Such upgrade can be performed initially in the factory or later at a dealership.

Below the barrel 29 and parallel thereto extends the tubular magazine 15 whose rear end is received by the magazine receiver 13. A standard reloading mechanism having a tiltable loading scoop is positioned in the housing 1 behind the tubular magazine 15. The loading scoop is, for instance, supported via bore holes 11 drilled in the middle anchor juts.

The illustrated automatic shot gun may be equipped with tubular magazines 15 having different lengths, starting with a capacity of 2 cartridges for trap and skeet guns or for sale in countries which do not permit automatic shot guns with a higher magazine capacity, like Germany, up to a capacity of 7 cartridges when the automatic shot gun is used as a defense or service weapon. In the latter case, the barrel 29 which usually extends beyond the front magazine end, can be shortened until the barrel terminates flush with the magazine end.

The muzzle of barrel 29 may include, depending on the intended use of the automatic shot gun, a fixed twisting bore, a receiving part for interchangeable inserts each having a different twisting bore, or a cylinder bore. Forces caused by the recoil which are exerted onto the barrel 29 via the twisting bore, are transmitted by the barrel to the reduction sleeve 17. The resulting load is then transmitted from the reduction sleeve 17 via the barrel receiver 5 to the entire coupling 3 and therefrom spread over a wide area and transmitted into the plastic wall of the housing 1.

The barrel 29 is closed by a breech when a cartridge 23 has been fired. The breech is formed by a breech block 25 positioned near the barrel, a breech carrier 27 which is movable rearwards in relation to the block over a limited distance, and two locking juts 19 which are movable in a direction perpendicular to the direction of movement of the breech. Immediately before a shot is fired, each of the locking juts 19 meshes with the respective recess 21 in the manner illustrated in FIG. 1.

In the side of the housing 1 facing away from the viewer of FIG. 1, an ejection window is provided near the breech carrier 27. This window is extended rearwardly by a slot in which the loading lever is movably disposed. The loading lever, in turn, is attached to the breech carrier 27, passes through the side wall of housing 1 and is provided with a handle on the outside of the housing.

A closure spring (not shown) supported in an indentation inside the rear wall of the housing 1 is positioned between the rear side of the breech carrier 27 and the rear end wall of housing 1. If a striking pin 37 positioned as shown in FIG. 1 and passing through the center of the breech carrier 27 and the breech block 25, is pushed forward by a striking mechanism (not shown), then the cartridge 23 in the cartridge holder is fired. The resulting recoil impacts the entire breech. The rear outer beveled end faces of the locking juts 19 of the breech are supported by the rear bevels of the recesses 21. Hence the locking juts are pressed against each other. The locking juts 19, too, have bevels at their rear inside ends, against which the forward end of the breech carrier 27 having mated bevels is biased by the closure spring. When the locking juts 19 disengage from the recesses 21, the breech block 25 moves rearward by an equal distance. At the same time, the breech carrier 27 moves rearward with higher and preferably approximately twice the velocity, opposing the force of the closure spring.

When the locking juts 19 strike each other, the entire breech opens. The locking juts 19 block the path of the striking pin 37, such that the gun can no longer be fired with the breech unlocked.

During this process, tremendous forces are exerted which attempt to deform the part containing the recesses 21. This part comprises the separate reduction sleeve 17 which is capable of accepting and equalizing all opposing forces, such that only the remaining forces will have to be transmitted into the barrel receiver 5. Hereby, the small elastic deformations of the reduction sleeve 17 are not transmitted to the barrel receiver 5. The resulting forces are then transmitted by the reduction sleeve 17 via the coupling 3 to the plastic material and uniformly distributed therein, whereby the coupling 3 and the plastic material are in contact over a substantial area and enmeshed.

The guideway of the breech can be formed in a manner that the breech carrier 27 pushes the locking juts 19 slightly apart when the breech is closed, so that they strike the counterbore of the reduction sleeve 17. Subsequently, they are again moved completely inward, whereby they push the breech block 25 and the breech carrier 27 apart and herewith slow the entire breech down.

A particular advantage of this breech arrangement, as compared with the standard movable barrel, is the relatively brief duration of the recoil which is elastically absorbed without damage by the plastic material of housing 1. It is also an advantage that only a relatively small mass has to be moved during the reloading process. Hence, the reloading process proceeds without problems even when the shot gun is not held firmly.

The invention is not limited by the embodiments described above which are presented as examples only but can be modified in various ways within the scope of protection defined by the appended patent claims.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

We claim:

1. A repeater shot gun comprising a plastic housing;

at least one barrel rigidly attached to the housing when the gun is assembled;

the barrel having a rear portion;

a coupling including a barrel receiver rigidly positioned in the housing, such that the barrel receiver substantially coaxially surrounds the rear portion of the barrel and the barrel is in close-fitting engagement with the barrel receiver;

wherein the coupling comprises at least one anchor jut, the anchor jut extending at least partially into the plastic housing; and wherein the at least one anchor juts extends substantially parallel longitudinally within the housing.

2. The repeater shot gun according to claim 1, wherein at least one anchor jut comprises at least one through bore hole.

3. The repeater shot gun according to claim 1, wherein the coupling is disposed in the plastic housing.

4. The repeater shot gun according to claim 1, wherein the plastic housing comprises a breech having at least one guide notch.

5. The repeater shot gun according to claim 4, wherein the barrel receiver comprises a reduction sleeve for accepting the rear portion of the barrel and wherein the reduction sleeve comprises at least two opposing recesses within the reduction sleeve, and at least two corresponding locking juts formed on the breech.

6. The repeater shot gun according to claim 5, wherein a) at least one of the recesses is beveled where the one of the two opposing recesses faces away from the barrel;

b) the at least two corresponding locking juts are movable in a direction perpendicular to the longitudinal axis of the barrel;

c) further comprising a biasing means which acts on one of the at least two locking jut and forces the one of the at least two locking juts into the corresponding recess; and d) upon firing of a shot and resulting recoil, one of the two locking jut is pressed against the bevel which functions as a radial cam, and disengages from the respective recess counteracting the biasing means.

7. The repeater shot gun according to claim 5, wherein the reduction sleeve is manufactures of metal.

8. The repeater shot gun according to claim 5, wherein the reduction sleeve is manufactured of a material with properties similar to those of metals with respect to deformation and strength.

9. The repeater shot gun according to claim 5, wherein the barrel and the barrel receiver are connected by threading means.

10. The repeater shot gun according to claim 1, wherein the plastic housing comprise holding means for connecting an auxiliary device on the housing.

11. The repeater shot gun according to claim 10, wherein the auxiliary device is a gun-stock.

12. The repeater shot gun according to claim 1 wherein the coupling is manufactured of metal.

13. The repeater shot gun according to claim 1, wherein the coupling is manufactured of a material having properties similar to those of metals with respect to deformation and strength.

14. The repeater shot gun according to claim 1, wherein the repeater shot gun is an automatic shotgun.

15. The repeater shot gun according to claim 1, wherein the repeater shot gun is a self loading shotgun.

16. A repeater shot gun comprising a plastic housing;

at least one barrel rigidly attached to the housing when the gun is assembled;

the barrel having a rear portion;

a coupling including a barrel receiver rigidly positioned in the housing, such that the barrel receiver substantially coaxially surrounds the rear portion of the barrel and the barrel is in close-fitting engagement with the barrel receiver; and further comprising a reloading magazine receiver disposed in the coupling.

17. The repeater shot gun according to claim 16, wherein a) the barrel receiver and the magazine receiver are disposed on the coupling substantially parallel, the barrel receiver being located above the magazine receiver; and b) the magazine receiver further comprising a tubular magazine.

18. A repeater shot gun according to claim 17, further comprising:

a) connecting means for rigidly connecting the tubular magazine and the magazine receiver; and b) attaching means for rigidly attaching the barrel to the tubular magazine.

* * * * *